US006664220B2

(12) United States Patent
Mayhall et al.

(10) Patent No.: US 6,664,220 B2
(45) Date of Patent: Dec. 16, 2003

(54) REMOVING ADHERENT ORGANIC MATERIAL

(75) Inventors: Jennifer Riley Mayhall, Belews Creek, NC (US); Eddie D. Sowle, Woodbury, MN (US); Charles Allen Hodge, Cottage Grove, MN (US)

(73) Assignee: Kay Chemical, Inc., Greensboro, NC (US)

( * ) Notice: Subject to any disclaimer, the term of this patent is extended or adjusted under 35 U.S.C. 154(b) by 169 days.

(21) Appl. No.: 09/824,733

(22) Filed: Apr. 4, 2001

(65) Prior Publication Data

US 2003/0022803 A1 Jan. 30, 2003

(51) Int. Cl.[7] ..... C11D 3/08

(52) U.S. Cl. ..... 510/218; 510/433; 510/272; 510/435; 510/511

(58) Field of Search ..... 510/433, 272, 510/435, 511, 175, 491, 434, 238, 499, 218

(56) References Cited

U.S. PATENT DOCUMENTS

| | | | | | |
|---|---|---|---|---|---|
| 4,105,574 | A | | 8/1978 | Culmone et al. | 252/154 |
| 4,116,848 | A | | 9/1978 | Schoenholz et al. | 252/90 |
| 4,477,288 | A | | 10/1984 | Kazmierczak et al. | 134/19 |
| 4,528,039 | A | | 7/1985 | Rubin et al. | 134/2 |
| 4,537,638 | A | | 8/1985 | Petersen et al. | 134/2 |
| 4,704,234 | A | | 11/1987 | Petersen et al. | 252/542 |
| 4,844,744 | A | * | 7/1989 | Leiter et al. | 134/40 |
| 5,234,505 | A | * | 8/1993 | Winston et al. | 134/40 |
| 5,342,450 | A | | 8/1994 | Cockrell, Jr. et al. | 134/3 |
| 5,380,454 | A | | 1/1995 | Griepenburg et al. | 252/174.14 |
| 5,565,419 | A | | 10/1996 | Thomas et al. | 510/197 |
| 5,786,319 | A | * | 7/1998 | Pedersen et al. | 510/423 |
| 5,972,866 | A | | 10/1999 | Ahmed | 510/218 |

FOREIGN PATENT DOCUMENTS

| | | |
|---|---|---|
| EP | 0 227 195 A2 | 7/1987 |
| EP | 0 379 093 A1 | 7/1990 |
| WO | WO 96/16132 | 5/1996 |
| WO | WO 96/25465 | 8/1996 |
| WO | WO 00/20544 | 4/2000 |
| WO | WO 00/68351 | 11/2000 |

* cited by examiner

*Primary Examiner*—Gregory E. Webb
(74) *Attorney, Agent, or Firm*—Merchant & Gould, LLC

(57) ABSTRACT

A solution capable of removing adherent organic material from the surface of a solid substrate at room temperature. The solution includes a first solvent, preferably water, having dissolved therein: up to 2% alkali metal silicates, a source of alkalinity that is substantially free of alkali metal hydroxide ions, an organic solvent, and an amount of hydrotrope effective to render the organic solvent or solvents soluble in the solution, an amino alcohol may be included, at least one surfactant, and a corrosion inhibitor may be included. The solution should have an alkaline pH less than about 12. The solution is used to remove the adherent organic material by soaking the object having such material thereon in such a solution, preferably at room temperature.

31 Claims, No Drawings

REMOVING ADHERENT ORGANIC MATERIAL

FIELD OF THE INVENTION

The present invention relates to the removal of adherent organic material from solid substrates, and more particularly to the removal of carbonized organic material from the surfaces of metal cookware.

BACKGROUND OF THE INVENTION

The preparation of many baked and fried foods creates residue on the surface of the cookware that is comprised primarily of adherent organic material. Such material can be an adherent viscous or solid organic material, caramelized organic material or carbonized organic material. The removal of such materials has conventionally been done by abrasion or the use of chemically aggressive substances, such as solvents or caustic materials activated by heat.

Removing such materials by abrasion is labor intensive and can affect the surface of the material being cleaned. While chemical removal of adherent organic material from the surface of cookware can be done with a number of conventional chemicals, these materials are generally difficult to work with in that they cause skin or eye irritation, require heating of the surface to be cleaned or are corrosive to certain cookware, especially aluminum. Thus, the primary objective of the present invention is to provide a material that removes adherent organic material from the surface of solid substrates, such as cookware, that does not require heat, that is not toxic and does not generate irritating fumes, does not irritate the skin, and does not corrode aluminum cookware and is easily rinsed from the cleaned surface with water.

Additional objects and advantages of the invention will be set forth in the description which follows, and in part will be obvious from the description, or may be learned by practice of the invention. The objects and advantages of the invention may be realized and obtained by the combinations particularly pointed out in the appended claims.

SUMMARY OF THE INVENTION

In accordance with the purpose of the invention as embodied and broadly described herein, the invention includes a solution for removing adherent, organic material from the surface of a solid substrate at room temperature. The solution comprises a first solvent, most preferably water, having dissolved therein up to 2% alkali metal silicates. The solution further includes a source of alkalinity that is substantially free of alkali metal hydroxide ions. The solution further includes at least one organic solvent in an amount up to 20%, and an amount of hydrotrope effective to render the organic solvent soluble in the solution. Up to 10% of amino alcohol is included in the solution. The solution also contains at least one surfactant in an amount up to 25%, and up to 15% of a corrosion inhibitor.

Another embodiment of the invention is a method for removing adherent organic material from the surface of a solid substrate at room temperature. In such an embodiment a solvent, preferably water, has dissolved therein up to 2% alkali metal silicates. The solution further includes a source of alkalinity that is substantially free of alkali metal hydroxide ions. The solution further includes at least one organic solvent in an amount up to 20%, and an amount of hydrotrope effective to render the organic solvent soluble in the solution. Up to 10% of amino alcohol is included in the solution. The solution also contains at least one surfactant in an amount up to 25%, and up to 15% of a corrosion inhibitor. Substrates, such as cookware, having adherent organic material are placed within the solution for a period of time effective to react with the adherent organic material and convert the organic material to a form that it can be readily removed from the substrate.

The solution of the present invention finds particular utility in cleaning the surface of aluminum cookware, and especially anodized aluminum cookware.

DESCRIPTION OF THE PREFERRED EMBODIMENTS

In accordance with the invention, there is provided a solution capable of removing adherent organic material from the surface of the solid substrate at room temperature. While such solutions are operable at room temperature and are advantageous because of there being no necessity to heat the system in order to provide a cleaning affect, heating of the solution may assist in the cleaning process. The invention includes a first solvent, the most preferred embodiment being water, with a combination of materials dissolved therein. While the invention has shown particular utility in an aqueous solution, the amount of solvent can be reduced but typically such solutions have no more than 80% water. More preferably, the water content should be no more than 75%.

The percentages set out herein are weight percentages, unless specifically set out otherwise.

In accordance with the invention, there is provided a source of alkalinity and that source should be substantially free of alkali metal hydroxide ions. Preferably, the source of alkalinity consists essentially of an alkali metal carbonate, examples being potassium carbonates, sodium carbonate, or mixtures thereof. The higher pH provided by the source of alkalinity contributes to the removal of the adherent organic material. Preferably, the overall solution has an alkaline pH less than 12, although a pH above 12 can be used where corrosion of the metal substrate is not an issue. In its most preferred embodiment, a water solution, the pH is preferably in the range of from 10 to 12, and most preferably about 11. In connection with the pH the word "about" means plus or minus a pH value of 0.5. In the preferred embodiment, the alkali metal carbonate comprises from 5 to 11% of the solution and in the most preferred embodiment, approximately 9%. Amounts of alkali metal carbonate in excess of 11% are operable but are more corrosive to metals like aluminum. Higher concentrations of alkali metal carbonate may be used but the concentration of corrosion inhibitors would have to be adjusted if corrosion of the metal being cleaned was to be avoided.

It is important that the source of alkalinity not contribute an excessive amount of free metallic ions to the solution, as the presence of free metallic ions causes flocculation within the solution. While this may not always degrade the performance of the solution with respect to removing adherent organic material, it is not preferred. It is also preferred that the source of alkalinity include materials that serve as a good chelating agent to decrease the level of free metallic ions in the solution. Other sources of alkalinity, such as hydroxides, are not preferred for cleaning aluminum or anodized aluminum surfaces due to their propensity to corrode or attack the metal surface being cleaned and to increase skin irritation if the solution contacts humans or animals. Several sources of alkalinity, hydroxides in particular, also decrease the rinseability of the solution from the metal substrate being cleaned making rinsing of said substrate difficult and time consuming. For these reasons, hydroxides are not preferred for cleaning aluminum or anodized aluminum surfaces. Other sources of alkalinity other than carbonates include phosphates, borates, gluconates, silicates, and other salts of organic acids, as well as amines and amides.

In accordance with the invention, the solution includes at least one organic solvent in an amount up to 20%, and an amount of hydrotrope effective to render the organic solvent soluble in aqueous solutions. As here embodied, the organic solvent comprises one selected from the group consisting of dipropylene glycol normal propyl ether and N-methyl-pyrrolidone, in an amount of approximately 7% of a solution in the preferred embodiment. Dipropylene glycol normal propyl ether can be obtained from ARCO Chemical of Newtown, Pa., USA and is known commercially as Arcosolv DPNP. N-methyl-pyrrolidone is known commercially as NMP or m-pyrol and can be obtained from ISP Technologies Inc. of Wayne, N.J., USA. The function of the solvent is to promote the release of the organic material from the surface of the substrate being cleaned. One of the advantages of the present invention is that, in addition to emulsifying the adherent organic material, it removes such material from the surface of the solid substrate being cleaned by breaking the bond between the organic material and the surface of the substrate. While not wishing to be bound by theory, it appears that the solution delaminates the layers of the adherent organic material as well as breaking the chemical or physical bond of that material on the surface to be cleaned. In an aqueous solution, the solvent normally requires a hydrotrope to render it soluble in the solution. As will be discussed with respect to other components of the solution, many of them also have hydrotroping properties and assist in the dissolution of the organic solvent within the aqueous medium. Where a separate hydrotrope is used, it can consist essentially of sodium xylene sulfonate.

In accordance with the invention, the solution may include at least one corrosion inhibitor. As here embodied, the corrosion inhibitor can consist essentially of at least one fatty acid. Examples of fatty acids that can be used with respect to the present invention include caprylic acid and stearic acid. Other acids may include decanoic acid, lauric acid, dodecinoic acid, palmitic acid, myristic acid, and mixtures thereof. The fatty acids should be present in an amount up to 15%, with 2% being most preferred. Bicarbonates can also be used as corrosion inhibitors, alone or in combination with other corrosion inhibitors. The use of a corrosion inhibitor is particularly useful when removing adherent organic material from relatively reactive metal surfaces such as aluminum.

In accordance with the invention, an amino alcohol may be included to provide cleaning power to the solution. The amino alcohol is an emulsifier and helps loosen the carbon on the surface being cleaned. Preferably, the amino alcohol is present in an amount up to 10% of the solution, most preferably in an amount of 4%. Preferably, the amino alcohol is 2-amino-2-methyl-1-propanol. Such a material is known commercially as AMP-95 and is a product of Angus Chemical Company of Buffalo Grove, Ill., USA. Amounts in excess of 8 to 10% of amino alcohol are operable but raise toxicity issues with the solution. In certain applications toxicity may not be of concern, as for example cleaning or decarbonizing machine or engine parts, but in the preferred embodiment, the level of amino alcohol is such that there are no known significant toxicity effects and the solution can be handled without special precautions.

In accordance with the invention, the solution contains at least one surfactant in an amount up to about 25% to promote cleaning of the organic material from the surface of the substrate. As here embodied, the surfactant is an amphoteric surfactant that consists essentially of sodium lauriminodipropionate in an amount up to 2%. Such a material is known commercially as Mackam 160C-30, a product of McIntyre Group, Ltd. of University Park, Ill., USA. While the use of an amphoteric surfactant is preferred, anionic, non-ionic or amphoteric surfactants can be used.

In accordance with the invention, up to 2% alkali metal silicate can be included to provide corrosion protection to the metals being cleaned. As here embodied, the alkali metal silicate consists essentially of potassium silicate and in a preferred embodiment the potassium silicate comprises up to 0.25% of the solution. In such amounts the surface of the material being cleaned is not corroded and no significant amount of precipitates or flocculents are formed within the solution. Excess silicates in the solution may produce a heavy white stain on aluminum cookware that is undesireable. More importantly, the formation of undesirable silicates on the surface to be cleaned should be avoided as they are difficult to remove without the use of aggressive chemicals. In addition to potassium silicate, sodium silicates, or a mixture of potassium and sodium silicate can be used. In the embodiments tested the mixture of potassium and sodium silicate and use of sodium silicate alone produced more flocculent than potassium silicate alone. The presence of a precipitate or flocculent does not affect the performance of the solution, but its presence is not preferred.

An additional material that improves the performance of the solution by inhibiting attack or corrosion of the metal surface being cleaned is the presence of at least one phosphate ester. Phosphate esters are known corrosion inhibitors and examples of proprietary groups of products know to be operable are materials known as TMulz, a product of Harcroft Organics of Kansas City, Kans., USA, Rhodafac, a product of Rhodia Chemical Co. of Cranbury, N.J., USA and Chemphos, a product of Chemron of Paso Robles, Calif., USA. In addition, some phosphate esters are hydrotropes in the present invention. Bicarbonates are another material that can be used as a corrosion inhibitor. Bicarbonates buffer the system and prevent excessive free alkalinity.

As embodied herein the invention is a solution, and while its performance is not significantly affected by use (in other words the active ingredients of the solution are not consumed in the cleaning process), its performance is affected by the concentrations changing due to evaporation of the volatile ingredients, primarily the water and organic solvents. Thus, it is preferred to keep containers of the solution covered to prevent the evaporation of the water or organic solvents. In addition, as the solvents evaporate the silicate concentrations exceed the preferred amounts and flocculation or staining can result. Evaporation of the organic solvents also affects the performance of the solution for removing adherent organic material.

The present invention was used in connection with a number of examples, as set out below.

EXAMPLE 1

A solution comprising the following ingredients was prepared, with all percentages by weight relative to the total weight of the solution.

| | |
|---|---|
| Water | 72.7% |
| Potassium Silicate (Kasil#1)[1] | 1.3% |
| $K_2CO_3$ | 9.0% |
| 2-amino-2-methyl-1-propanol (AMP-95)[2] | 4.0% |
| N-methyl-pyrrolidone (NMP)[3] | 3.0% |

-continued

| | |
|---|---|
| Dipropylene glycol normal propyl ether (DPNP)[4] | 7.0% |
| Sodium Lauriminodipropionate (Mackam 160C-30)[5] | 3.0% |

[1]a product of PQ Corporation of Valley Forge, PA, USA
[2]a product of Angus Chemical Co. of Buffalo Grove, Ill. USA
[3]a product of ISP Technology Inc. of Wayne NJ, USA
[4]product of ARCO Chemical of Newtown, Pennsylvania, USA
[5]product of McIntyre Group, Ltd. of University Park, Illinois, USA The cleaning performance of the solution was tested by submerging a variety of "soiled" pizza pans in a vessel containing 4 gallons of the solution at room temperature. The cooking surface of the "soiled" pans had an adherent film of cooking oil and food, with at least a portion of the oil and food being carbonized. For the first part of the test, a soiled 14" bare aluminum deep dish pan (Pan 1) and a 14" soiled anodized aluminum deep dish pizza pan (Pan 2) were submerged in the solution for a total of 72 hours. After 18.5 hours, 26 hours, and 72 hours, the pans were removed from the solution and visually inspected for degree of carbonized matter removal. The results are provided in Table 1, with percentages referring to the percentage of adherent matter removed from the pizza pan. The solution of this example contained flocculent, but the performance was not adversely affected.

TABLE 1

| Pan No. | Pan Type | Removal | Total Soak Time |
|---|---|---|---|
| 1 | Bare 14" Deep Dish | ≧90% | 18.5 hrs |
| 2 | Anod. 14" Deep Dish | ≧75% | 18.5 hrs |
| 1 | Bare 14" Deep Dish | ≧97% | 26 hrs |
| 2 | Anod. 14" Deep Dish | ≧80% | 26 hrs |
| 1 | Bare 14" Deep Dish | ≧99% | 72 hrs |
| 2 | Anod. 14" Deep Dish | ≧85% | 72 hrs |

Pans 1 and 2 were removed from the solution following the 72 hour period. Eight soiled pizza pans were then submerged in the same solution for a 90 hour period. The pans comprised a mixture of 12" bare aluminum thin and 14" bare aluminum deep dish pans. The pans were soaked for periods of 90 hours and 140 hours (6 days). At the end of each of the two soaking periods, the pans were removed and visually inspected to determine the degree of adherent matter removal. Following the inspection at 90 hours, the pans were again submerged until the final inspection at the conclusion of 140 hours. The results are provided below in Tables 2 and 3.

TABLE 2

| Pan No. | Pan Type | Removal | Total Soak Time |
|---|---|---|---|
| 3 | 12" Bare Thin | ≧90% | 90 hrs |
| 4 | 12" Bare Thin | ≧90% | 90 hrs |
| 5 | 12" Bare Thin | ≧90% | 90 hrs |
| 6 | 14" Bare Deep Dish | ≧90% | 90 hrs |
| 7 | 14" Bare Deep Dish | ≧90% | 90 hrs |
| 8 | 14" Bare Deep Dish | ≧90% | 90 hrs |
| 9 | 14" Bare Deep Dish | ≧90% | 90 hrs |
| 10 | 14" Bare Deep Dish | ≧90% | 90 hrs |

TABLE 3

| Pan No. | Pan Type | Removal | Total Soak Time |
|---|---|---|---|
| 3 | 12" Bare Thin | ≧90% | 140 hrs |
| 4 | 12" Bare Thin | ≧95% | 140 Hrs |
| 5 | 12" Bare Thin | ≧95% | 140 Hrs |
| 6 | 14" Bare Deep Dish | 98% | 140 Hrs |
| 7 | 14" Bare Deep Dish | 98% | 140 Hrs |
| 8 | 14" Bare Deep Dish | ≧98% | 140 Hrs |
| 9 | 14" Bare Deep Dish | ≧99% | 140 Hrs |
| 10 | 14" Bare Deep Dish | ≧99% | 140 Hrs |

These results demonstrate the effectiveness of the solution in cleaning pizza pans, even in a period of time less than the standard seven-day soak cycle at room temperature.

EXAMPLE 2

Many cleaning solutions have a corrosive effect on metal cookware, especially aluminum cookware. This example demonstrates the effect of the solution of Example 1 on bare aluminum and anodized aluminum pizza pans.

A clean, bare aluminum pizza pan and a clean, anodized aluminum pizza pan were each placed in the solution of Example 1 to soak overnight. The pans were removed after the overnight soaking and were inspected for signs of corrosion or degradation. A visual inspection showed that the pans appeared to be free of corrosion and surface attack. The pans were again submerged in the cleaning solution and were permitted to soak for an additional 48 hours. At the end of the additional 48 hours, the pans were visually inspected. The pans showed no visible signs of corrosion or attack by the solution.

EXAMPLE 3

Another test was performed using pans from actual pizza restaurants. The following solution was prepared, with all percentages by weight relative to the total weight of the solution:

| | |
|---|---|
| Water | 72.7% |
| Potassium Silicate (Kasil#1) | 1.3% |
| RU Silicate | 1% |
| $K_2CO_3$ | 9% |
| AMP-95 | 4% |
| DPNP | 7% |
| NMP | 3% |
| Mackam 160C-30 | 3% |

The pizza pans were soaked in tubs containing 8 gallons of cleaning solution for one or more seven day intervals, providing for seven day "soak cycles." Fifty-six pizza pans having adherent organic matter on their cooking surfaces were cleaned in this test. The tested pans included both bare aluminum and anodized 7", 12", and 14" deep dish, thin, and thin perforated pans. After the pans were used for preparing pizzas, they were submerged in the solution. The submersion was for a period of time sufficient to remove at least 95% of the adherent material on the surface of the pans. The results are summarized in Table 4, with the soak time provided in days:

TABLE 4

| | All Pan Types | Anodized Aluminum | Bare Aluminum |
|---|---|---|---|
| Average Soak Time | 11 | 13 | 8 |
| Minimum Soak Time | 3 | 3 | 4 |
| Maximum Soak Time | 23 | 23 | 16 |
| Total Number of Pans Cleaned | 56 | 29 | 27 |

The results of this test demonstrate that the solution is effective for cleaning adherent organic matter, including carbonized material, from pizza pans. The solution provided cleaner pizza pans in a relatively short period of time. In addition, it was determined that the solution was as effective in cleaning the first pan as it was in cleaning the $56^{th}$ pan. Significantly, the containers holding the solution and the pans were covered except when loading the pans into the containers to minimize evaporation from the solution.

EXAMPLE 4

Five solutions were prepared and evaluated for both cleaning performance and stability. They are listed in Table 5, with all percentages by weight relative to the total weight of the solution:

TABLE 5

| | 1 | 2 | 3 | 4 | 5 |
|---|---|---|---|---|---|
| Water | 74.25 | 73.72 | 75.75 | 73.25 | 72.25 |
| $K_2CO_3$ | 9 | 9 | 9 | 9 | 9 |
| Kasil | 0.25 | 0.25 | 0.25 | 0.25 | 0.25 |
| AMP-95 | 4 | 4 | 4 | 4 | 4 |
| NMP | 3 | 3 | 3 | 3 | 3 |
| DPNP | 7 | 7 | 7 | 7 | 7 |
| Caprylic Acid | 1 | 1 | 1 | 2 | 2 |
| TMulz1227[1] | 1.5 | — | — | 1.5 | — |
| Mackam | — | 2 | — | — | 2 |

[1]Phosphate Ester Blend

Slight to very slight flocculation was observed in each of the five prepared solutions. Soiled bare aluminum thin and soiled anodized aluminum deep dish pizza pans were submerged in a basin containing one of the five solutions for 70 hours. At the end of the 70 hour test period, the pans were removed and visually inspected for both soil-removal performance and corrosion. The results are provided in Table 6.

TABLE 6

| Comp. No. | Bare Thin (% removal) | Anodized Deep Dish (% removal) | Corrosion |
|---|---|---|---|
| 1 | ≧99% | 30% | None |
| 2 | ≧99% | 45% | None |
| 3 | 60% | 25% | None |
| 4 | 95% | 10% | None |
| 5 | 50% | 5% | None |

The pans were all then replaced in the same solutions for an additional 72.5 hours with the tops of the containers covered. The total submersion time, 70 hours plus 72.5 hours, approximates a typical soak cycle used in the test of Example 3. The results of the combined 142.5 hour soak time are provided in Table 7.

TABLE 7

| Comp. No. | Bare Thin (% removal) | Anodized Deep Dish (% removal) | Corrosion |
|---|---|---|---|
| 1 | 100% | 50% | None |
| 2 | 100% | 60% | None |
| 3 | 95% | 75% | None |
| 4 | ≧99% | 20% | None |
| 5 | 75% | 40% | None |

EXAMPLE 5

Seven solutions were prepared an evaluated for appearance, stability, and performance. The solutions are listed in Table 8, with all amounts given in percentage by weight relative to the total weight of the solution.

TABLE 8

| | 1 | 2 | 3 | 4 | 5 | 6 | 7 |
|---|---|---|---|---|---|---|---|
| Water | 74.25 | 73.72 | 75.75 | 73.25 | 72.25 | | |
| RU Silicate | 0.25 | 0.25 | — | — | — | — | — |
| Kasil | — | — | 0.25 | 0.2 | 0.2 | 0.1 | 0.1 |
| $K_2CO_3$ | 9 | 9 | 9 | 9 | 9 | 9 | 9 |
| AMP-95 | 4 | 4 | 4 | 4 | 4 | 4 | 4 |
| NMP | 3 | 3 | 3 | 3 | 3 | 3 | 3 |
| DPNP | 7 | 7 | 7 | 7 | 7 | 7 | 7 |
| Mackam | 2 | 1 | 1 | 2 | 1 | 2 | 1 |
| Caprylic Acid | 1 | 1 | 1 | 1 | 1 | 1 | 1 |
| Appearance | cloudy | cloudy | clear | clear | clear | clear | clear |

Anodized aluminum deep dish and bare aluminum thin pizza pans were submerged in vessels containing one of the seven solutions for 95 hours (4 days), which is less than the standard seven-day soak cycle. At the end of the 95 hour period, the pans were removed and evaluated for cleaning performance, stability, and attack, if any, on the pizza pans. The results are provided in Table 9. The percentages refer to the amount of adherent organic material removed from the pans.

TABLE 9

| Comp. No. | Anod. Deep Dish (% rem) | Bare Thin (% rem) | Observations | Stability |
|---|---|---|---|---|
| 1 | 100% | 95% | Possible attack | flocc../cloudy |
| 2 | 100% | 90% | No attack | flocc./cloudy |
| 3 | 100% | 99% | No attack | slight flocc./ cloudy |
| 4 | 100% | 99% | No attack | very slight flocc. |
| 5 | 100% | 99% | No attack | very slight flocc. |
| 6 | 100% | 95% | Attack on anod. | very very slight flocc. |
| 7 | 100% | 100% | No attack | none |

The solutions exhibit acceptable cleaning performance and stability, and their corrosive effect on the pans was either non-existent or within acceptable ranges.

The present invention has been disclosed in terms of its preferred embodiments. The scope of the invention is to be determined, not by the disclosed embodiments, but by the appended claims, as such claims would be understood by those of ordinary skill in the disclosed technology, in light of the specification. The invention is a combination of ingredients and those skilled in the art may find ways to alter that combination by means of further chemical additions to the solutions specifically disclosed and claimed. Moreover, the amounts set out in the embodiments, and even the claims may be changed and still achieve the benefits of the invention. Such modifications are considered to be within the scope of the invention, as set out in the attached claims and their equivalents.

What is claimed is:

1. A solution capable of removing adherent organic material from the surface of a solid substrate at room temperature, said solution comprising:

a first solvent, having dissolved therein, up to 2% alkali metal silicate;

a source of alkalinity, said source being substantially free of alkali metal hydroxide ions;

at least one organic solvent in an amount up to 20%, and an amount of hydrotrope effective to render said organic solvent soluble in said solution;

from greater than 0 to 10% amino alcohol;

at least one surfactant in an amount up to 25%; and up to 15% corrosion inhibitor;

said solution having an alkaline pH less than about 12.

2. The solution of claim 1, wherein said first solvent consists essentially of water, and said first solvent comprises no more than 80% of said solution.

3. The solution of claim 2, wherein said water comprises no more than 75% of said solution and said solution has a pH in the range of from about 10 to 12.

4. The solution of claim 1, wherein said alkali metal silicate consists essentially of potassium silicate.

5. The solution of claim 4, wherein said potassium silicate comprises up to 0.25% of said solution.

6.The solution of claim 1, wherein said source of alkalinity consists essentially of at least one alkali metal carbonate.

7. The solution of claim 6, wherein said alkali metal carbonate is selected from the group consisting of potassium carbonate, sodium carbonate, and mixtures thereof.

8. The solution of claim 6, wherein said alkali metal carbonate comprises from 5 to 11% of said solution.

9.The solution of claim 8, wherein said alkali metal carbonate comprises about 9% of said solution.

10. The solution of claim 1, wherein said amino alcohol consists essentially of 2-amino-2-methyl-1-propanol.

11. The solution of claim 10, wherein said amino alcohol comprises about 4% of said solution.

12. The solution of claim 1, wherein said organic solvent comprises one selected from the group consisting of dipropylene glycol normal propyl ether and N-methyl-pyrrolidone.

13. The solution of claim 1, wherein said organic solvent comprises about 7% of said solution.

14. The solution of claim 1, wherein said surfactant consists essentially of sodium lauriminodipropionate.

15. The solution of claim 1, wherein said surfactant comprises up to 2% of said solution.

16. The solution of claim 1, wherein said hydrotrope consists essentially of either said corrosion inhibitor, said surfactant or both.

17. The solution of claim 1, wherein said solution includes a material introduced solely as a separate hydrotrope, said separate hydrotrope consisting essentially of sodium xylene sulfonate.

18. The solution of claim 1, wherein said corrosion inhibitor consists essentially of at least one fatty acid.

19. The solution of claim 18, wherein said fatty acid comprises one selected from the group consisting of caprylic acid and stearic acid.

20. The solution of claim 1, wherein said substrate consists essentially of bare or anodized aluminum and said solution contains at least one corrosion inhibitor.

21. The solution of claim 1, wherein said corrosion inhibitor consists essentially of at least one phosphate ester.

22. A solution capable of removing carbonized organic material from the surface of an anodized aluminum substrate at room temperature, said solution comprising:

water, having dissolved therein, up to 0.25% potassium silicate;

from 5 to 11% of at least one alkali metal carbonate comprises one selected from the group consisting of potassium carbonate, and sodium carbonate;

at least one organic solvent in an amount up to 20%, said organic solvent comprising one selected from the group consisting of dipropylene glycol normal propyl ether and N-methyl-pyrrolidone, and an amount of hydrotrope effective to render said organic solvent soluble in said solution;

up to 10% amino alcohol consisting essentially of 2-amino-2-methyl-1-propanol;

a surfactant consisting essentially of sodium lauriminodipropionate in an amount up to 25%; and at least one corrosion inhibitor in an amount up to 15%, said corrosion inhibitor consisting essentially of at least one fatty acid, said solution having a pH in the range of from 10 to 12.

23. The solution of claim 22 wherein said pH is about 11.

24. The solution of claim 1, wherein said solution comprises:

from greater than 0 to 2% potassium silicate;

from greater than 0 to 11% of a source of alkalinity, said source of alkalinity consists essentially of at least one alkali metal carbonate;

at least one organic solvent in an amount ranging from greater than 0 to 20%, said organic solvent comprises one selected from the group consisting of dipropylene glycol normal propyl ether and N-methyl-pyrrolidone;

from greater than 0 to 10% 2-amino-2-methyl-1-propanol;

at least one surfactant in an amount ranging from greater than 0 to 25%, said at least one surfactant comprises sodium lauriminodipropionate; and from greater than 0 to 15% corrosion inhibitor comprising at least one fatty acid.

25. A solution capable of removing adherent organic material from the surface of a solid substrate at room temperature, said solution comprising:

a first solvent, having dissolved therein, up to 2% alkali metal silicate;

a source of alkalinity, said source being substantially free of alkali metal hydroxide ions;

at least one organic solvent in an amount up to 20%, and an optional hydrotrope in an amount effective to render said organic solvent soluble in said solution;

from greater than 0 to 10% of 2-amino-2-methyl-1-propanol; and at least one surfactant in an amount up to 25%;

said solution having an alkaline pH less than about 12.

26. The solution of claim 25, wherein said solution further comprises up to 15% corrosion inhibitor comprising at least one fatty acid.

27. The solution of claim 25, wherein said solution further comprises up to 15% corrosion inhibitor, wherein said corrosion inhibitor consists essentially of at least one phosphate ester.

28. The solution of claim 25, wherein said solution comprises:

from greater than 0 to 2% potassium silicate;

from greater than 0 to 11% of a source of alkalinity, said source of alkalinity consists essentially of at least one alkali metal carbonate;

at least one organic solvent in an amount ranging from greater than 0 to 20%, said organic solvent comprises one selected from the group consisting of dipropylene glycol normal propyl ether and N-methyl-pyrrolidone; and at least one surfactant in an amount ranging from greater than 0 to 25%, said at least one surfactant comprises sodium lauriminodipropionate.

29. A solution capable of removing adherent organic material from the surface of a solid substrate at room temperature, said solution comprising:

a first solvent, having dissolved therein, up to 2% alkali metal silicate;

a source of alkalinity, said source being substantially free of alkali metal hydroxide ions;

at least one organic solvent in an amount up to 20%, and an amount of hydrotrope effective to render said organic solvent soluble in said solution;

up to 10% amino alcohol;

at least one surfactant in an amount up to 25%; and up to 15% corrosion inhibitor, wherein said corrosion inhibitor consists essentially of at least one phosphate ester;

said solution having an alkaline pH less than about 12.

30. The solution of claim 29, wherein the amino alcohol consisting essentially of 2-amino-2-methyl-1-propanol.

31. The solution of claim 29, wherein said solution comprises:

from greater than 0 to 2% potassium silicate;

from greater than 0 to 11% of a source of alkalinity, said source of alkalinity consists essentially of at least one alkali metal carbonate;

at least one organic solvent in an amount ranging from greater than 0 to 20%, said organic solvent comprises one selected from the group consisting of dipropylene glycol normal propyl ether and N-methyl-pyrrolidone;

from greater than 0 to 10% 2-amino-2-methyl-1-propanol;

at least one surfactant in an amount ranging from greater than 0 to 25%, said at least one surfactant comprises sodium lauriminodipropionate.

* * * * *